US006848888B2

(12) United States Patent
Du et al.

(10) Patent No.: US 6,848,888 B2
(45) Date of Patent: Feb. 1, 2005

(54) SENSOR FOR A VARIABLE DISPLACEMENT PUMP

(75) Inventors: Hongliu Du, Dunlap, IL (US); Mark P. Vonderwell, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 40 days.

(21) Appl. No.: 10/317,210

(22) Filed: Dec. 12, 2002

(65) Prior Publication Data

US 2004/0115065 A1 Jun. 17, 2004

(51) Int. Cl.[7] ..... F04B 49/12
(52) U.S. Cl. ..... 417/53; 417/63; 417/222.1
(58) Field of Search ..... 417/63, 53, 212, 417/222.1, 222.2, 218; 60/445; 91/505, 506; 92/5 R, 12.1, 13

(56) References Cited

U.S. PATENT DOCUMENTS 4,462,491 A * 7/1984 Kono et al. ..... 192/84.1
4,822,252 A * 4/1989 Ishikawa et al. ..... 417/222.2
5,059,097 A * 10/1991 Okazaki et al. ..... 417/222.2
5,407,328 A 4/1995 Kimmura et al. ..... 417/222.1
5,562,424 A 10/1996 Manring ..... 417/222.1
5,564,905 A 10/1996 Manring ..... 417/222.1
5,567,123 A 10/1996 Childress et al. ..... 417/222.1
5,659,485 A * 8/1997 Lee ..... 700/282
6,247,900 B1 * 6/2001 Archibald et al. ..... 417/222.1
6,374,722 B1 4/2002 Du et al. ..... 91/506
6,375,433 B1 4/2002 Du et al. ..... 417/53

* cited by examiner

*Primary Examiner*—Charles G. Freay
(74) *Attorney, Agent, or Firm*—Finnegan, Henderson, Farabow, Garrett & Dunner

(57) ABSTRACT

A sensor for a variable displacement pump is provided. The pump has a housing containing a swashplate that is adapted to rotate about an axis. The sensor includes a magnet connected to the swashplate to rotate with the swashplate. A semiconductor chip is disposed proximate the magnet and within the housing. A control is adapted to direct a current through the semiconductor chip and to determine the voltage across the semiconductor chip. The control is further adapted to determine the angle of the swashplate relative to the housing based on the determined voltage.

30 Claims, 2 Drawing Sheets

SENSOR FOR A VARIABLE DISPLACEMENT PUMP

TECHNICAL FIELD

The present invention is directed to a sensor for a variable displacement pump, and, more particularly, to a sensor for measuring the angular position of a swashplate in a variable displacement pump.

BACKGROUND

Variable displacement pumps are commonly used in many different types of hydraulic systems. Some vehicles, such as, for example, work machines, commonly include hydraulic pumps that are driven by an engine or motor in the vehicle to generate a flow of pressurized fluid. The pressurized fluid may be used for any of a number of purposes during the operation of the vehicle. A work machine, for example, may use the pressurized fluid to propel the machine around a work site or to move a work implement on the work machine.

A variable displacement pump typically draws operating fluid, such as, for example, oil, from a reservoir and applies work to the fluid to increase the pressure of the fluid. The pump may include a pumping element, such as, for example, a series of pistons, that increase the pressure of the fluid. The pump may also include a variable angle swashplate that drives the pistons through a reciprocal motion to increase the pressure of the fluid.

A pump that includes a variable angle swashplate may also include a mechanism that varies the angle of the swashplate to change the stroke length of the pistons and thereby vary the displacement of the pump. The displacement of the pump may be decreased by changing the angle of the swashplate to shorten the stroke length of the pistons. Alternatively, the displacement of the pump may be increased by changing the angle of the swashplate to increase the stroke length of the pistons.

The amount of pressurized fluid required from a variable displacement pump may vary depending upon the particular operating conditions of the system or vehicle that relies upon the pump. In a vehicle application, the overall efficiency of the vehicle may be improved by varying the displacement of the pump to match the requirements of the vehicle. For example, if the vehicle requires less pressurized fluid, the angle of the swashplate may be changed to decrease the stroke length of the pistons. If the vehicle requires more pressurized fluid, the angle of the swashplate may be changed to increase the stroke length of the piston.

A vehicle or system may include a control system that monitors the operating requirements and controls the operation of the pump to match the requirements. To effectively match the output of the pump with the requirements of the vehicle or system, the control system monitors the current output of the pump by, for example, sensing the angle of the swashplate. If the control system can accurately determine the angle of the swashplate, the control system can accurately estimate the current output of the pump. The control system can then adjust the angle of the swashplate to match the requirements of the vehicle.

A variable displacement pump may include a sensor to monitor the angle of the swashplate. A swashplate sensor may be based on any of several different principles. For example, a swashplate sensor may be based on mechanical, light, electrical, or magnetic principles. However, the known sensors that are based on these principles are either unsuitable for use in a variable displacement pump or result in a significant increase in the overall cost in the pump.

For example, one type of swashplate angle sensor, manufactured by Rexroth, is based on a combination of electrical and magnetic principles known as the Hall effect. This sensor utilizes permanent magnets that are attached to the swashplate and extend outside the pump housing. A Hall-effect semiconductor chip is disposed between the permanent magnets. By directing a current through the semiconductor chip and measuring the resulting voltage across the chip, the angle of the swashplate may be determined. However, obtaining an effective seal between the pump housing and the member projecting outside the pump housing is difficult and expensive. In addition, any magnetic materials near the sensor may interfere with the operation of the sensor.

The sensor of the present invention solves one or more of the problems set forth above.

SUMMARY OF THE INVENTION

One aspect of the present invention is directed to a sensor for a variable displacement pump having a housing containing a swashplate that is adapted to rotate about an axis. The sensor includes a magnet connected to the swashplate to rotate with the swashplate. A semiconductor chip is disposed proximate the magnet and within the housing. A control is adapted to direct a current through the semiconductor chip and to determine the voltage across the semiconductor chip. The control is further adapted to determine the angle of the swashplate relative to the housing based on the determined voltage.

In another aspect, the present invention is directed to a method of sensing the angular position of a swashplate in a variable capacity pump. A swashplate disposed within a housing is rotated about an axis. A current is directed through a semiconductor chip that is disposed within the housing and proximate a magnet connected to the swashplate. The voltage across the semiconductor chip is measured. The angle of the swashplate relative to the housing is determined based on the measured voltage across the semiconductor chip.

It is to be understood that both the foregoing general description and the following detailed description are exemplary and explanatory only and are not restrictive of the invention, as claimed.

DETAILED DESCRIPTION

Figure 1:
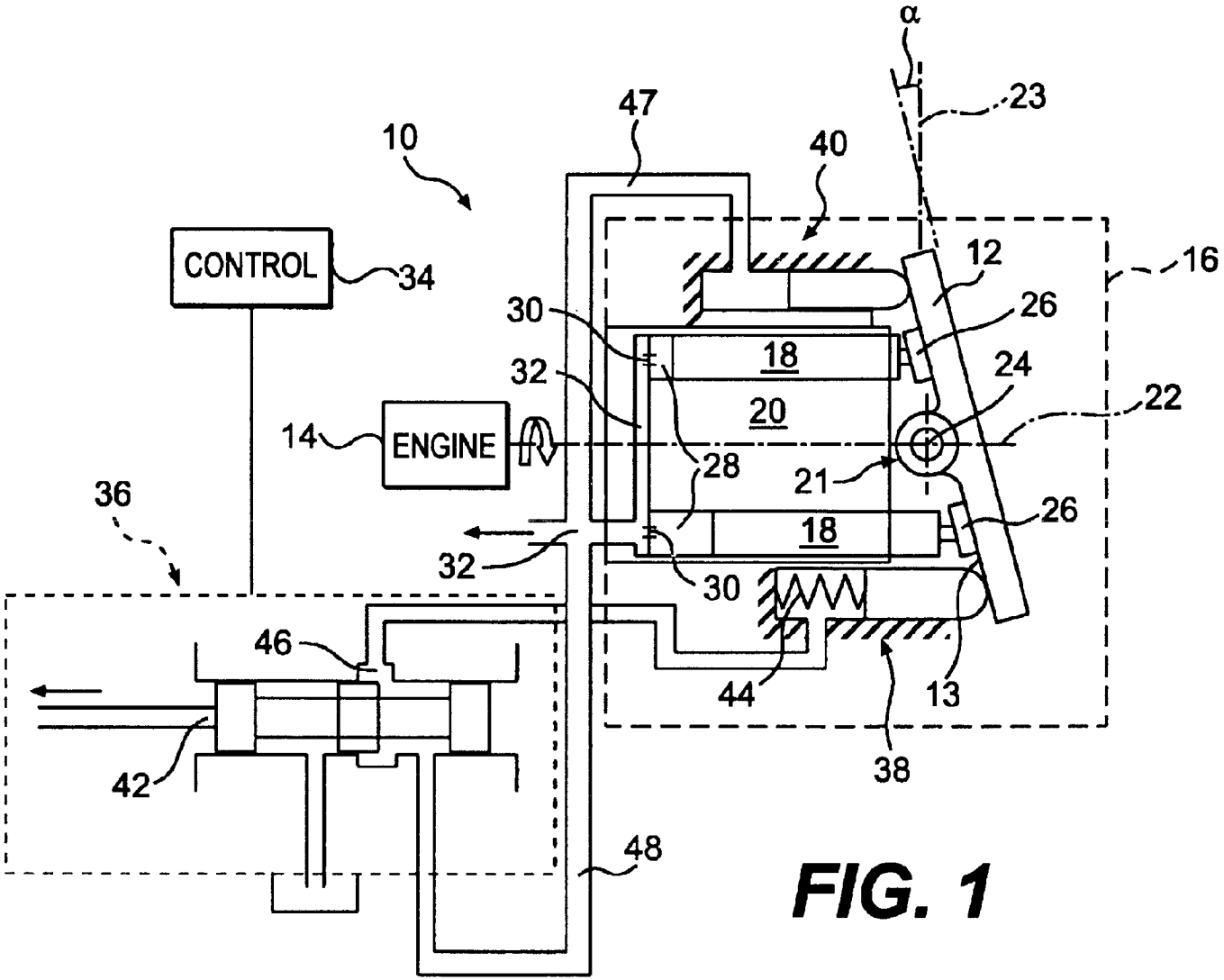
FIG. 1 is a schematic and diagrammatic illustration of a variable displacement pump having a sensor according to an exemplary embodiment of the present invention.

An exemplary embodiment of a variable displacement pump 10 is illustrated in FIG. 1. As shown, pump 10 includes a block 20 that is disposed in a housing 16 to rotate about a block axis 22. Block 20 defines a series of chambers 28, two of which are illustrated in FIG. 1. Each chamber includes an outlet port 30.

Pump 10 also includes a series of pistons 18. One piston 18 is slidably disposed in each chamber 28. The piston 18 is typically held against the swashplate 12 using either a fixed clearance device or a positive force hold-down mechanism (not shown) through a slipper 26.

A shaft (not shown) may be connected to block 20. A rotation of the shaft causes a corresponding rotation of block 20 about block axis 22. The shaft may be driven by an engine 14. Engine 14 may be, for example, an internal combustion engine. One skilled in the art will recognize, however, that the shaft may be driven by another type of power source, such as, for example, an electrical motor.

Pump 10 also includes a swashplate 12 that has a driving surface 13. Each piston 18 is biased into engagement with driving surface 13. Slipper 26 includes a joint, such as, for example, a ball and socket joint, is disposed between each piston 18 and swashplate 12. Each joint allows for relative movement between swashplate 12 and each piston 18.

Swashplate 12 may be disposed at an angle, $\alpha$ relative to housing 16. For the purposes of the present disclosure, angle $\alpha$ will be measured from a line 23 that is drawn perpendicularly from block axis. 22. One skilled in the art will recognize, however, that the swashplate angle may be measured using a different reference point.

When block 20 is rotated, the combination of the angled driving surface 13 of swashplate 12 and the force of the spring in each chamber 28 will drive each piston 18 through a reciprocating motion within each chamber 28. When piston 18 is moving under the force of the spring and away from outlet port 30, fluid is allowed to enter chamber 28. When piston 18 is moving towards outlet port 30 under the force of the driving surface of swashplate 12, the piston 18 acts on the fluid in chamber 28 to increase the pressure of the fluid. When the pressure of the fluid in chamber 28 reaches a certain level, the fluid is allowed to flow through port 30 to a fluid outlet 32. A check valve (not shown) or other similar device, may be positioned in outlet port 30 to control the pressure at which fluid is released from chamber 28 to fluid outlet 32.

The angle $\alpha$ of swashplate 12 relative to housing 16 controls the stroke length of each piston 18 and the displacement rate of pump 10. Increasing the swashplate angle $\alpha$ will result in a greater stroke length of each piston 18. Conversely, reducing the swashplate angle $\alpha$ will result in a reduced stroke length of each piston 18. An increase in the stroke length of each piston 18 will increase the amount of fluid that is pressurized to the predetermined level during each rotation of block 20. A decrease in the stroke length of each piston 18 will decrease the amount of fluid that is pressurized to the predetermined level during each rotation of block 20.

A joint 21 may be disposed between swashplate 12 and housing 16 to allow swashplate to rotate about a swashplate axis 24. Joint 21 allows the angle $\alpha$ of swashplate 12 relative to housing 16 to be varied. Joint 21 may have any configuration readily apparent to one skilled in the art. Pump 10 may be configured to limit the rotational range of swashplate 12. For example, the rotational range of swashplate 12 may be limited to a minimum displacement position of approximately 0° and a maximum displacement position of approximately 20°.

Pump 10 may also include a mechanism to vary the angle $\alpha$ of swashplate 12. For the purposes of the present disclosure, a hydraulically controlled mechanism will be described. One skilled in the art will recognize, however, that another type of mechanism, such as, for example, a solenoid driven actuator, may be used to vary the angle $\alpha$ of swashplate 12.

The angle varying mechanism may include a first piston 38 and a second piston 40 that engage opposite sides of swashplate 12. A fluid line 48 directs a flow of fluid from pump outlet 32 to a spool valve 36. The flow of fluid then flows through a spool valve outlet 46 to first piston 38 to thereby exert a force on swashplate 12. Another fluid line 47 may also direct a flow of fluid from pump outlet 32 to second piston 40 to thereby exert a force on the opposite side of swashplate 12. When the force exerted by first piston 38 on swashplate 12 exceeds the force exerted by second piston 40 on swashplate 12, swashplate 12 will rotate in a first direction. When the force exerted by second piston 40 on swashplate 12 exceeds the force exerted by first piston 38, swashplate 12 will rotate in the opposite direction.

Spool valve 36 may control the pressure of the fluid acting on first piston 38 to thereby control the force exerted on swashplate 12 by first piston 38. Spool valve 36 may include an adjustable spool 42. By controlling the position of spool 42, the pressure of the fluid flowing through spool valve outlet 46 to first piston 38 may be controlled.

Spool valve 36 may be controlled to adjust the angle $\alpha$ of swashplate 12. By increasing the pressure of the fluid acting on first piston 38, the force exerted by first piston 38 on swashplate 12 may be increased to increase the angle $\alpha$ of swashplate 12. By reducing the pressure of the fluid acting on first piston 38, the force exerted by first piston 38 on swashplate 12 may be decreased to decrease the angle $\alpha$ of swashplate 12.

A spring 44 may be engaged with first piston 38 to bias the swashplate 12 towards the maximum displacement position. Thus, when spool 42 of spool valve 36 allows a maximum fluid pressure to be directed to first piston 38 and the pressures of the fluid acting on each of first and second pistons 38 and 40 are essentially equal, spring 44 will act to move swashplate 12 to the maximum displacement position.

A control 34 may be provided to control spool valve 36 to thereby control the angle $\alpha$ of swashplate 12. Control 34 may include an electronic control module that has a microprocessor and a memory. As is known to those skilled in the art, the memory is operatively connected to the microprocessor and stores an instruction set and variables. Associated with the microprocessor and part of electronic control module are various other known circuits such as, for example, power supply circuitry, signal conditioning circuitry, and solenoid driver circuitry, among others.

Control 34 may be programmed to control the operation of pump 10 based on different input parameters. For example, in a work machine, control 34 may monitor the motions of a work implement or the requested movement of the work machine itself to determine the demand for pressurized fluid. When control 34 determines that the pressurized fluid requirements exceed the current output of pump 10, control 34 may adjust spool valve 36 to increase the angle $\alpha$ of swashplate 12 and thereby increase the displacement of pump 10.

To determine whether the pump displacement needs adjustment, control 34 may determine the current displacement of pump 10. This may be achieved by determining the current angle $\alpha$ of swashplate 12. As one skilled in the art will recognize, the current displacement of pump 10 may be determined based on the angle $\alpha$ of swashplate 12.

Figure 2:
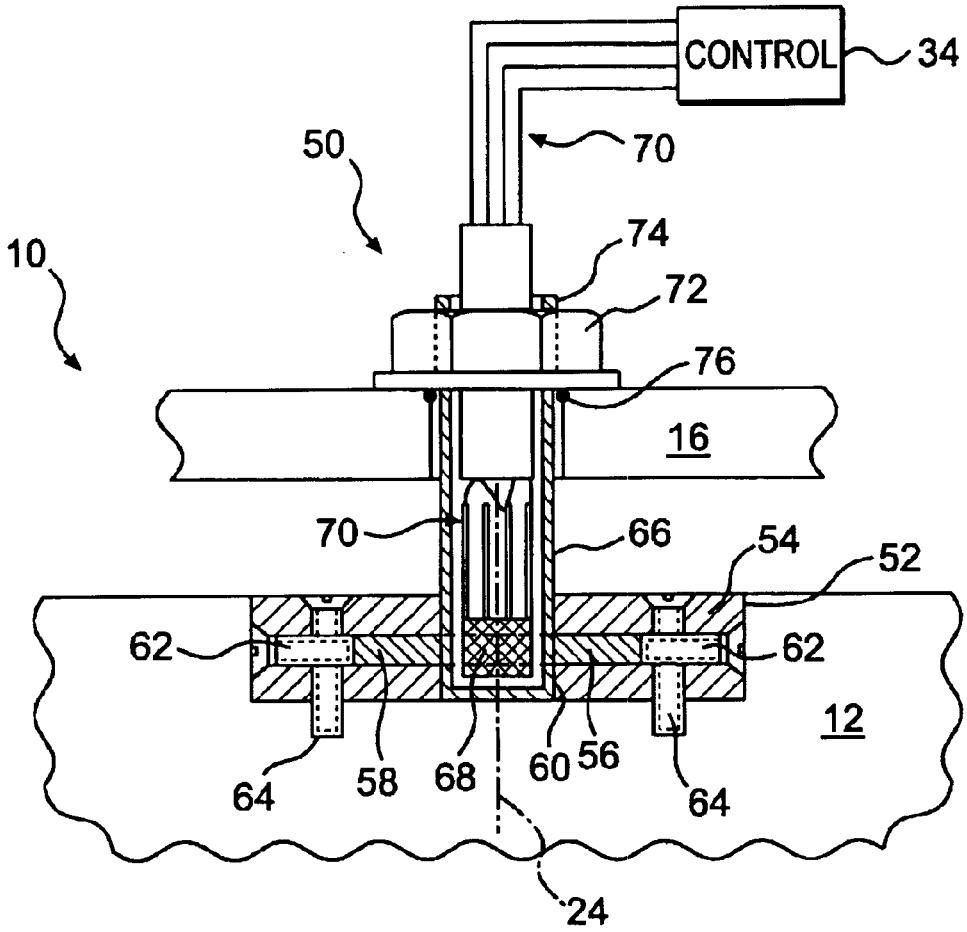
FIG. 2 is a cross-sectional diagrammatic illustration of a sensor according to an exemplary embodiment of the present invention.

As shown in FIG. 2, a sensor 50 may be engaged with pump 10 to sense the angle $\alpha$ of swashplate 12. Sensor 50 includes a mounting block 54 that is made of a non-magnetic material, such as, for example, plastic, Teflon, or plexi-glass. Mounting block 54 may have a circular shape and may include a central opening 60.

Mounting block 54 may be disposed in an opening 52 in swashplate 12. A pair of screws 64 may be disposed through mounting block 54 to secure mounting block 54 to swashplate 12. Mounting block 54 may be connected to joint 21 (referring to FIG. 1) of swashplate 12 so that the center of opening 60 substantially aligns with swashplate axis 24.

A first magnet 56 and a second magnet 58 may be disposed proximate opening 60 in mounting block 54. Each of the first and second magnets 56 and 58 may be permanent bar magnets. One skilled in the art will recognize that other types of magnets may also be used. A second pair of screws 62 may be disposed in mounting block 54 to hold first and second magnets 56 and 58 in place relative to opening 60.

First and second magnets 56 and 58 may be aligned so that opposite poles of each magnet are adjacent opening 60. For example, the north pole of first magnet 56 may be disposed on one side of opening 60 and the south pole of second magnet 58 may be disposed on the opposite side of opening 60. This arrangement will generate a magnetic flux across opening 60. The strength of the magnet flux will depend upon the strength and proximity of first and second magnets. First and second magnets 56 and 58 may be positioned in mounting block 54 so that the respective poles of the magnets are as close as possible to opening 60.

Sensor 50 also includes a stationary member 66 that has an outer surface 74 and extends through housing 16. Stationary member 66 may be made of a non-magnetic material, such as, for example, plastic, Teflon, or plexiglass. A semiconductor chip 68, such as, for example a Melexis programmable MLX90215 Hall effect chip, may be disposed at one end of stationary member 66.

Outer surface 74 of stationary member 66 is configured to be received in opening 60 of mounting block 54. Stationary member 66 may be positioned relative to mounting block 54 to dispose semiconductor chip 68 in the magnetic flux generated between first and second magnets 56 and 58. A bearing, or other movement facilitating device, such as, for example, a lubricant, may be disposed between stationary member 66 and mounting block 54.

Outer surface 74 of stationary member 66 may be threaded to allow a nut 72 to secure stationary member 66 to housing 16 and prevent stationary member 66 from moving relative to housing 16. As there is no relative movement between stationary member 66 and housing 16, the opening in housing 16 for stationary member 66 may be easily sealed. For example, a sealing member 76, such as an o-ring, may be disposed between housing 16, nut 72, and stationary member 66 to form a seal therebetween.

Stationary member 66 may be hollow. A series of control wires 70 may extend from semiconductor chip 68 through stationary member 66. Control wires 70 may provide an electrical connection between semiconductor chip 68 and control 34.

Control 34 may be configured to direct a controlled current through semiconductor chip 68. Control 34 may further include a sensor or other device to measure the resulting voltage across semiconductor chip 68. Under the principles of the Hall effect, the voltage across semiconductor chip 68 will change in response to a change in the relative direction of the magnetic flux across the semiconductor chip 68.

Figure 3:
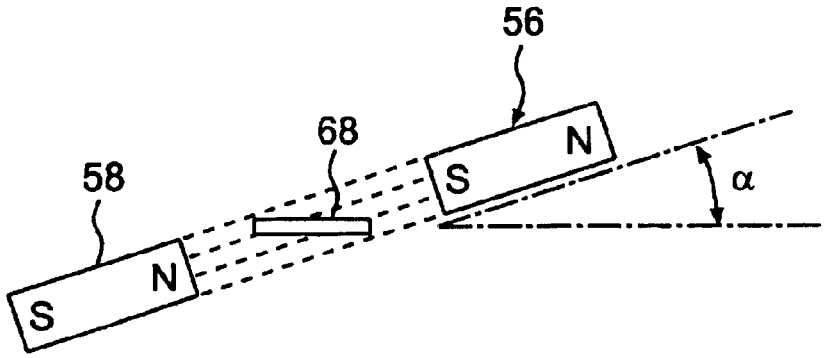
FIG. 3 is a diagrammatic illustration of an exemplary embodiment of a sensor according to the present invention.

As shown in FIG. 3, the direction of the magnetic flux across semiconductor chip 68 will change when first and second magnets 56 and 58 are rotated through an angle $\alpha$ relative to semiconductor chip 68. Because first and second magnets 56 and 58 are secured in mounting block 54, which is fixed to swashplate 12, and stationary member 66 is fixed to housing 16, the relative direction of the magnetic flux over semiconductor chip 68 will change with a change in the angle $\alpha$ of swashplate 12 relative to housing 16. The voltage across semiconductor chip 68 may be related to the angle $\alpha$ by the following formula:

$$v=k*\sin(\alpha),$$

where v is the voltage and k is a constant that depends on the strength of first and second magnets 56 and 58, the geometric configuration of sensor 50, and the characteristics of semiconductor chip 68.

Because the expected rotational range of swashplate 12 is relatively small, such as, for example, between 0° and 20°, the previous equation may be simplified to:

$$v=k*\alpha$$

Accordingly, the relationship between the voltage and the angle may be considered substantially linear over the expected rotational range of the sensor. This simplification in the relationship between the voltage and the angle will result in a low error over the expected rotational range. It is expected that the maximum error will not exceed 2%, or 0.4°, over a rotation range of 0° to 20°. One skilled in the art will recognize, however, that the sine wave based relationship may be used if the expected rotational range of first and second magnets 56 and 58 is increased or if this error level is unacceptable for the given application.

This linear relationship between the angle $\alpha$ and the voltage provides for a simple calibration of sensor 50. In particular, sensor 50 may be calibrated by measuring the voltage across semiconductor chip 68 at two known angles. In addition, this linear relationship provides for reduced manufacturing and assembly tolerances as the calibration process will account for any differences in alignment between semiconductor chip 68 and first and second magnets 56 and 58.

Semiconductor chip 68 may be programmed to account for changes in the magnetic flux generated by first and second magnets 56 and 58 due to changes in the temperature of sensor 50. Semi-conductor chip 68 may be programmed to account for the expected changes in the magnetic flux when the temperature of first and second magnets 56 and 58 changes. In this manner, the reliability of sensor 50 may be improved.

In addition, pump housing 16 will prevent other electrical or magnetic equipment from impacting the operation of sensor 50. Pump housing 16 will act as a shield for semiconductor chip 68 and first and second magnets 56 and 58. Accordingly, sensor 50 may be positioned in close proximity to other magnetic or electrical equipment without impacting the operation or accuracy of sensor 50. This may be particularly beneficial in a vehicle application, where the available space in an engine compartment is limited.

Control 34 may also compensate for any measurement hysterisis that may be induced by an angular velocity of first and second magnets 56 and 58, such as may be experienced when swashplate 12 is moving relative to housing 16. As one skilled in the art will recognize, the movement of first and second magnets 56 and 58 may induce an electric current in surrounding conductive materials. This induced electrical current may impact the measured voltage across semiconductor chip 68. Accordingly, control 34 may include a first order, low pass filter to compensate for any such measurement hysterisis.

INDUSTRIAL APPLICABILITY

As will be apparent from the foregoing description, the present invention provides a sensor 50 that may be used to determine the angular position of a swashplate 12 in a variable capacity pump 10. The sensor 50 provides an indication as to the current angle α of swashplate 12 relative to the pump housing 16. Control 34 may use the sensed angle α of swashplate 12 to determine the current displacement of pump 10 and to determine whether an adjustment in the swashplate angle α is necessary to either increase or decrease the displacement of the pump.

As will also be apparent from the foregoing description, the sensor 50 is robust, cost-effective, and reliable. The positioning of the moving parts of sensor 50 inside the pump housing 16 provides a shield for the sensor. Thus, the effects of system or vehicle vibration, pump output pressure fluctuations, fluid debris, and pump cavitations are minimized. In addition, the sensor 50 may be easily sealed with housing 16 because there is no relative movement between sensor 50 and housing 16.

It will be apparent to those skilled in the art that various modifications and variations can be made in the sensor of the present invention without departing from the scope of the invention. Other embodiments of the invention will be apparent to those skilled in the art from consideration of the specification and practice of the invention disclosed herein. It is intended that the specification and examples be considered as exemplary only, with a true scope of the invention being indicated by the following claims and their equivalents.

What is claimed is:

1. A sensor for a variable displacement pump having a housing containing a swashplate adapted to rotate about an axis, comprising:

a magnet connected to the swashplate to rotate with the swashplate;

a semiconductor chip disposed proximate the magnet and within the housing such that a substantially evenly distributed magnetic flux is created across the semiconductor chip by the magnet; and a control adapted to direct a current through the semiconductor chip and to determine the voltage across the semiconductor chip, the control further adapted to determine the angle of the swashplate relative to the housing based on the determined voltage.

2. The sensor of claim 1, wherein a pair of magnets are connected to the swashplate.

3. The sensor of claim 2, wherein each of the pair of magnets are permanent bar magnets.

4. The sensor of claim 2, further including a mounting block constructed of a non-magnetic material, having an opening, and adapted for engagement with the swashplate, wherein the pair of magnets are disposed in the mounting block proximate the opening.

5. The sensor of claim 4, wherein the pair of magnets are disposed in the mounting block such that a first pole of one of the pair of magnets is disposed proximate the opening and an opposite pole of the second of the pair of magnets is disposed across the opening from the first pole of the one of the pair of magnets.

6. The sensor of claim 4, further including a stationary member constructed of a non-magnetic material and adapted to hold the semiconductor chip.

7. The sensor of claim 6, wherein the stationary member is disposed within the opening of the mounting block to position the semiconductor chip between the pair of magnets.

8. The sensor of claim 7, wherein the semiconductor chip and the opening in the mounting block are substantially aligned with the axis of the swashplate.

9. The sensor of claim 4, further including a pair of screws disposed in the mounting block to prevent the pair of magnets from moving relative to the mounting block.

10. A method of sensing the angular position of a swashplate in a variable capacity pump, comprising:

rotating a swashplate disposed within a housing about a first axis to thereby vary the displacement of the pump;

maintaining the swashplate rotationally stationary about a second axis corresponding to the axis of the pump;

directing a current through a semiconductor chip disposed within the housing and proximate a magnet connected to the swashplate;

measuring the voltage across the semiconductor chip; and determining the angle of the swashplate relative to the housing based on the measured voltage across the semiconductor chip.

11. The method of claim 10, further including comparing the determined angle of the swashplate to a desired angle of the swashplate.

12. The method of claim 11, further including adjusting the angle of the swashplate relative to the housing when the determined angle of the swashplate is different from the desired angle of the swashplate.

13. A variable displacement pump, comprising:

a housing;

a swashplate disposed in the housing and adapted to rotate about an axis;

an adjustment mechanism operatively engaged with the swashplate and adapted to rotate the swashplate and thereby change an angle of the swashplate relative to the housing;

a magnet connected to the swashplate:

a semiconductor chip disposed within the housing and proximate the magnet such that a substantially evenly distributed magnetic flux is created across the semiconductor chip by the magnet; and a control adapted to direct a current through the semiconductor chip and to determine the voltage across the semiconductor chip, the control further adapted to determine the angle of the swashplate relative to the housing based on the determined voltage.

14. The pump of claim 13, wherein a pair of magnets are connected to the swashplate.

15. The pump of claim 14, further including a mounting block constructed of non-magnetic material, having an opening, and adapted for engagement with the swashplate, the pair of magnets being disposed in the mounting block proximate the opening.

16. The pump of claim 15, wherein the pair of magnets are disposed in the mounting block such that a first pole of one of the pair of magnets is disposed proximate the opening and an opposite pole of the second of the pair of magnets is disposed across the opening from the first pole of the one of the pair of magnets.

17. The pump of claim 15, further including a stationary member constructed of a non-magnetic material and adapted to hold the semiconductor chip.

18. The pump of claim 17, wherein the stationary member is disposed within the opening of the mounting block to position the semiconductor chip between the pair of magnets and wherein the semiconductor chip and the opening in the mounting block are substantially aligned with the axis of the swashplate.

19. The pump of claim 17, wherein the stationary member includes an outer surface projecting through the housing and having threads, and wherein the stationary member is secured to the housing with a nut.

20. The pump of claim 19, further including a sealing member disposed between the nut and the housing.

21. A sensor for a variable displacement pump having a housing containing a swashplate adapted to rotate about an axis, comprising:

a magnet connected to the swashplate to rotate with the swashplate;

a semiconductor chip disposed proximate the magnet and within an opening in the swashplate; and a control adapted to direct a current through the semiconductor chip and to determine the voltage across the semiconductor chip, the control further adapted to determine the angle of the swashplate relative to the housing based on the determined voltage.

22. The sensor of claim 21, wherein the semiconductor chip is aligned with said axis.

23. The sensor of claim 21, wherein a pair of magnets are connected to the swashplate.

24. A sensor for a variable displacement pump having a housing containing a swashplate adapted to rotate about an axis to thereby vary the displacement of the pump, comprising:

a magnet assembly connected to the swashplate to rotate with the swashplate;

a Hall element disposed interior of the magnet assembly; and a control adapted to direct a current through the Hall element and to determine the voltage across the Hall element indicative of an angle of rotation of the swashplate about the axis.

25. The sensor of claim 24, wherein the magnet assembly includes a pair of magnets connected to the swashplate.

26. The sensor of claim 25, wherein the Hall element is aligned with said axis.

27. The sensor of claim 25, wherein the Hall element and each magnet of the pair of magnets lie in a common plane.

28. The sensor of claim 24, wherein the Hall element is a semiconductor chip.

29. The sensor of claim 28, wherein the semiconductor chip is programmed to account for temperature variations.

30. The sensor of claim 24, wherein the Hall element is located in an opening in the swashplate.

* * * * *